US006121606A

United States Patent [19]

Voigt et al.

[11] Patent Number: 6,121,606

[45] Date of Patent: Sep. 19, 2000

[54] MULTI DETECTOR CLOSE PACKED ARRAY ROSETTE SCAN SEEKER

[75] Inventors: Allan A. Voigt, Anaheim; Scott K. Gordon, Claremont, both of Calif.

[73] Assignee: Raytheon Company, Lexington, Mass.

[21] Appl. No.: 06/887,962

[22] Filed: Jul. 8, 1986

Related U.S. Application Data

[63] Continuation of application No. 06/447,032, Dec. 6, 1982, abandoned.

[51] Int. Cl.[7] ..... H01J 3/14; G01C 21/02; G01J 5/02; F41B 7/00

[52] U.S. Cl. ..... 250/234; 244/3.16; 250/203.1; 250/203.6; 250/342

[58] Field of Search ..... 244/3.16; 250/203 R, 250/342, 578, 232, 234, 203.1, 203.6, 578.1

[56] References Cited

U.S. PATENT DOCUMENTS

| | | | |
|---|---|---|---|
| 3,444,380 | 5/1969 | Webb | 250/342 |
| 3,907,435 | 9/1975 | Roodvoets | 250/578 |
| 4,009,393 | 2/1977 | Ashley, Jr. et al. | 250/342 |
| 4,010,365 | 3/1977 | Meyers et al. | 250/334 |
| 4,039,246 | 8/1977 | Voigt | 250/203 R |
| 4,210,807 | 7/1980 | Ruger | 250/342 |
| 4,246,480 | 1/1981 | Clark | 250/332 |
| 4,329,579 | 5/1982 | Jansen et al. | 250/203 R |

*Primary Examiner*—Stephen C. Buczinski
*Attorney, Agent, or Firm*—David W. Collins; Andrew J. Rudd; Glenn H. Lenzen, Jr.

[57] ABSTRACT

A rosette or co-rotating vector scanning seeker detector array providing improved data rate and scanned field coverage. Several discrete detector elements are formed in an array on the detector surface in a coplanar arrangement, each of the detector elements providing target information when the scan sweeps across it. The array may be in the form of circular spots arranged around a central circular detector element. In an alternative embodiment, the central detector element is omitted and the peripheral detector elements are arranged sufficiently close together to preclude the likelihood of a target path passing between adjacent detector elements without being detected. Detector elements in a single array may be of different sizes and shapes.

43 Claims, 3 Drawing Sheets

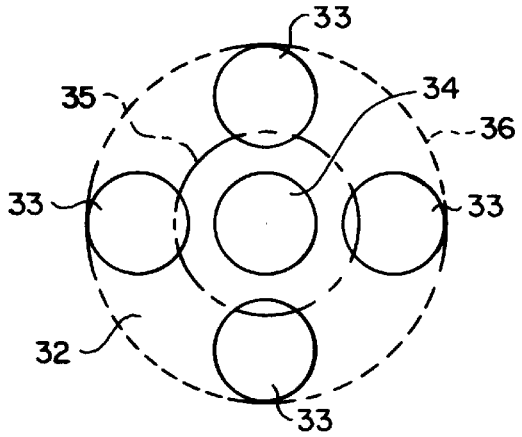
FIG. 3
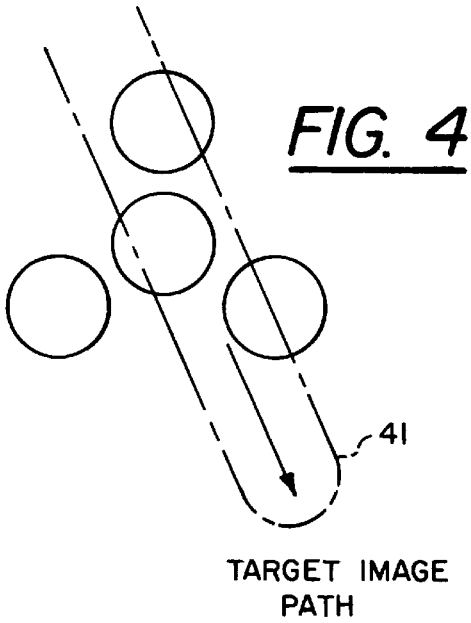
FIG. 4
FIG. 5
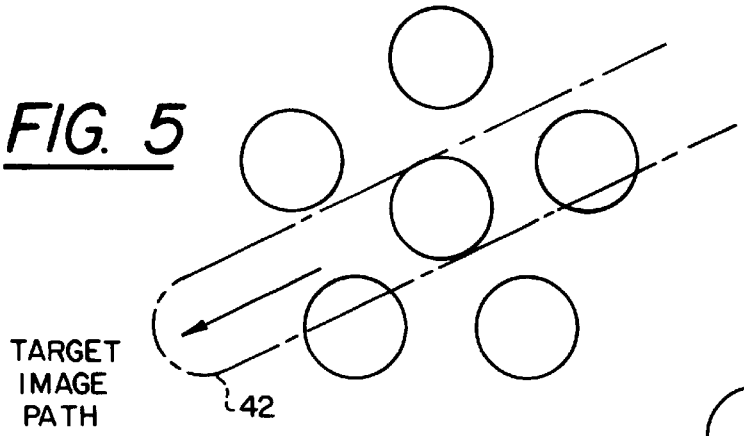
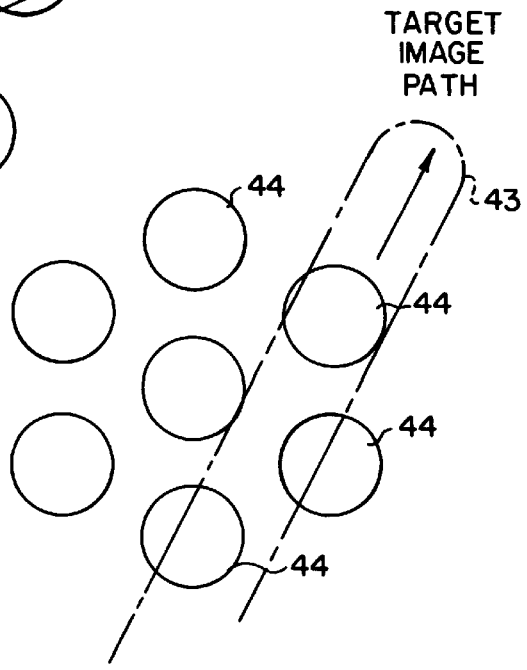
FIG. 6

MULTI DETECTOR CLOSE PACKED ARRAY ROSETTE SCAN SEEKER

This is a continuation of application Ser. No. 06/447,032 filed on Dec. 6, 1982, now abandoned.

FIELD OF THE INVENTION

This invention relates generally to scanning seekers and more particularly to an improved detector having an array of detector elements for use in a seeker having a rosette type scanning pattern for detecting distant objects.

DISCUSSION OF THE PRIOR ART

In gyro-optical objective systems and other optical telescope applications, it is frequently desirable to scan the field of a radiation sensor across the field of an optical objective to determine the orientation of the radiation source relative to the axis of the optical system. Of the various scanning patterns available, the rosette scan is particularly advantageous in that a radiation sensor with a relatively small field of view can be scanned across the entire field of the optical objective to produce a circular search pattern with a relatively large field of view. Of the variety of prior art systems utilized to produce a rosette scanning pattern, it has been found that two rotating mirrors may effectively be employed for that purpose.

The rosette scanner is utilized to scan the field of an optical objective to determine the direction, spatial origin, or spatial characteristics of a radiation source or radiation distribution pattern. A rosette scanning pattern is particularly applicable to a gyro-optical system used in the guidance of a radiation-seeking missile. A particularly significant virtue of the rosette lies in the fact that the maximum information sampling or data rate of the pattern exists at the center of the pattern which renders the system inherently less sensitive to the effects of spurious targets. When a target is in the total field of the rosette, but not coincident with the rosette pattern, pulse signals generated by the sensor provide error information to external processing circuitry. From this circuitry, a correctly phased precession signal is derived that is applied to the precession coils, which in turn generate the required magnetic flux to move the primary beam director means in the proper direction to return the target image to the center of the scanned rosette field. Typically, the optical components of the seeker apparatus are gimbaled so that the seeker system can maintain a lock on a target and continually track target angular deviations with respect to the primary optic access.

The existing seeker uses a single detector aperture which results in a significant variation of the data rate as a function of the pointing angle in the scanned field of view. It is possible to reduce these data rate variations by making the detector aperture larger but this results in both poorer system sensitivity as well as a reduced background rejection capability. A larger detector aperture has negative effects on seeker system performance in that its ability to discriminate between backgrounds such as clouds or hills and the item of interest or target is reduced. It might be possible to improve performance by gimbaling the detector, employing fiber optics or using a focal plane array system. All of these possible improvements are much more complex and expensive than a simple fixed position detector employed in conjunction with a gimbaled seeker. Gimbaled detectors are inherently large and go out of focus easily if they do not precisely follow the target. Fiber optic systems have certain advantages but they also require the distal ends of the fibers to be gimbaled.

Other prior art systems have used multiple sensors which are spread over an area which is large compared with the surface area of an individual sensor. In these systems, normally having a circular scanning pattern, it was found to be necessary to have an appreciable distance between each individual sensor in order to obtain the necessary information with the desired discrimination and sensitivity. Systems of this type which could be applicable to missile systems are not adaptable to spot scanning of a non-gimbaled detector array in a rolling airframe with normal seeker look angles.

SUMMARY OF THE INVENTION

Broadly speaking, this invention relates to an improved detector array for a rosette scan seeker. The detector array configuration of this invention enables performance of an existing seeker to be substantially improved.

It is an object of this invention to provide seeker performance which is substantially equivalent to the performance of seekers having more complex and expensive detector apparatus. This detector array provides results emulating those of gimbaled detectors, fiber optic detectors, or focal plane array systems.

The invention comprises a close packed array of a plurality of detector elements arranged in a pattern within a small diameter which may be only slightly larger than the diameter of existing single element detectors. Because the detector array has several discrete detector elements arranged in a close packed array, data rate is significantly improved over that of the single element configuration. The total detector surface size is such that all of the detector elements in the array are within acceptable focus at all seeker look angles, thereby obviating the need to gimbal the detector or employ fiber optics and at the same time greatly simplifying the seeker design.

Several detector array configurations are disclosed including a small central detector element with several other small discrete detector elements arranged around the center, a close packed circle of small individual detector elements with no central element, and oval detector elements radially spaced from the axis.

A further advantage of the present invention is that a seeker employing this detector array configuration can be readily used in a rolling airframe as well as in stable or dithering airframes, without any major complications. By way of contrast, focal plane array seekers present significant difficulties and complexities if they are to be adapted to rolling missiles.

BRIEF DESCRIPTION OF THE DRAWING

The objects, advantages and features of this invention will be more readily perceived from the following detailed description when read in conjunction with the accompanying drawing in which:

FIG. 3 shows a detector array pattern in accordance with the invention with an existing single detector element superimposed for reference purposes;

FIGS. 4–6 disclose alternative detector array embodiments showing possible target image paths crossing each array;

DESCRIPTION OF THE PREFERRED EMBODIMENTS

Figure 1:
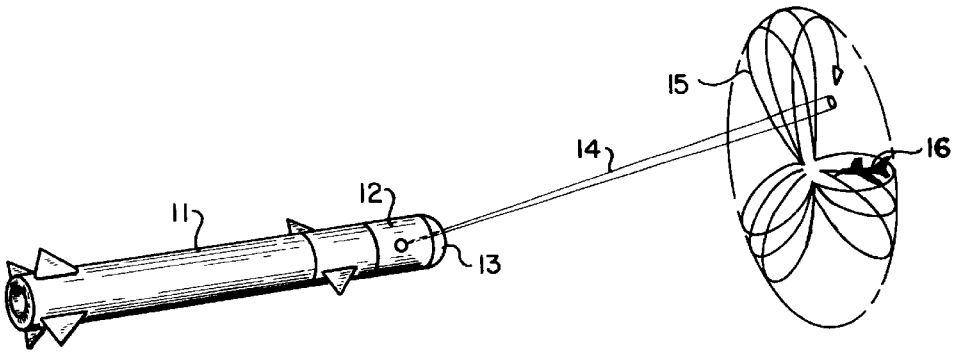
FIG. 1 is a simplified perspective view showing a rosette scanning pattern in relation to a typical missile having a seeker head incorporating the detector array of the present invention.

With reference now to the drawing and more particularly to FIG. 1 thereof, there is shown a typical vehicle or airframe 11 having a seeker head 12 in the vicinity of nose cone or dome 13. The projected field of view is illustrated by beam 14 which describes a rosette pattern 15, making up, in successive passes, the entire circular field of view of the objective. With this type of scan, the comparatively small instantaneous field of view of a radiation sensor in conjunction with the focal length of the objective is caused to describe rapid and repetitive sinusoidal excursions forming "leaves" which are displaced angularly at a relatively slower rate to constitute a circular geometric search pattern having a comparatively large field of view. The field of view is shown to include an intruder aircraft or target 16 which stimulates radiation sensor elements to produce electrical pulse signals whenever the field of view of the sensor coincides with the location of the target. The sensor signals, in turn, provide error information to cause an auxiliary precession system to properly reorient the seeker gyro-optical axis and thereby return the target image to the center of the scanned rosette field.

Figure 2:
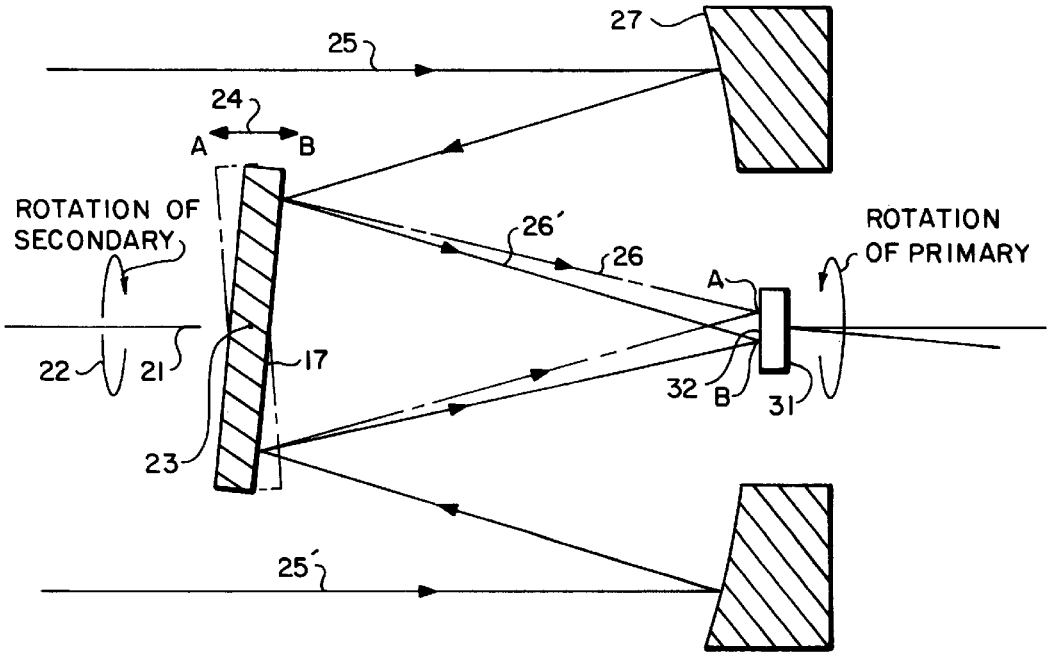
FIG. 2 is a sectional schematic diagram of a typical seeker optical system employed in the missile of FIG. 1.

With reference to FIG. 2, one component in the production of the rosette scan 15 involves the rotation of a secondary reflector or planar mirror 17 about its axis of rotation 21 in the direction indicated by arrow 22. Simultaneously, the planar mirror 17 may be oscillated about the axis of rotation 23 as indicated by double headed arrow 24. The mirror 17 causes the incident beams of light 25 and 25' to oscillate as a small spot of information between positions A and B of projected beams 26 and 26' on image plane detector surface 32. The cooperative relationship between primary reflector 27 and planar mirror 17 is also shown in FIG. 2. Parallel incident beams of light 25 and 25' from a distant target are illustrated as being reflected from the primary reflector 27 to planar mirror 17. In the B position of mirror 17, rays 26' converge at point B on planar detector surface 32 of detector base 31. In the A position of mirror 17, rays 26 converge at point A on the sensor surface of base 31. In this manner, the field of view of the detector surface of base 31 is scanned across the field of target 16.

The multiple oscillations during each rotation of mirror 17 produces an overlapping pattern wherein leaves of the rosette pattern 15 are generated and overlapped so that information from all sectors of the field of view of the objective are obtained with minimum delay. Thus the scanning patterns produced by the primary reflective surface 27 and secondary or planar mirror 17 combine to produce the rosette pattern 15. The rosette pattern is preferred for a seeker of the type shown in that the maximum data rate is obtained with target 16 at the central point and the structure shown schematically in FIG. 2 produces closure of the pattern. A significant virtue of the rosette scan lies in the fact that the system is inherently less sensitive to the effects of spurious targets or confusing spatial radiation pattern distribution. For additional information as to the details of the structure and operation of the apparatus of FIG. 2, see U. S. Pat. No. 4,039,246.

The disadvantages of the system of FIG. 2 where the sensing surface 32 of base 31 is formed as a single detector element have previously been mentioned. A preferred embodiment of the detector array configuration of the invention is shown in FIG. 3 where peripheral discrete detector elements 33 are arranged in a ring about a similar central element 34, with a typical prior art single detector 35 being superimposed on FIG. 3 for reference purposes. The detector array of FIG. 3 is shown to be somewhat greater in diameter (dotted circle 36) than the prior art single detector 35. The surface of the detector array of this invention, having a plurality of discrete detector elements in a close packed array, is preferably formed with a diameter 36 between one and five times the diameter of a single detector element 35. It is desirable that the total surface diameter 36 be in the range of about three to seven times the diameter of an individual detector element 33, 34.

It is important to note that detector elements 33, 34 shown in FIG. 3 are in a close packed arrangement. For purposes of this invention, close packed indicates that the distance between any two adjacent elements is equal to or less than the diameter of a single detector element. The minimum distance between elements is limited only by the practical requirements for fabricating the detector surface so that the elements provide discrete electrical signals pursuant to a target being scanned across them. By making the envelope diameter of the detector surface relatively small and the elements clustered in a close packed array, the detector array need not be gimbaled or connected by means of fiber optics since all detector elements are within acceptable focus at all seeker look angles. This results in a greatly simplified seeker structure with the advantages of much more complex configurations. Additionally, the small instantaneous field of view of each detector element provides excellent background rejection and system sensitivity, both in clear and in cluttered background conditions.

Several alternative configurations of detector elements for the detector array of this invention are shown in FIGS. 4–6. Each of these figures illustrates an example of typical target image paths 41–43 crossing the array. Note in each case that the target tends to illuminate several detector elements in sequence, especially for arrays with the larger number of elements. With appropriate electronics and logic, this sequential characteristic could be used as a target discriminant to improve sensitivity to valid targets while also improving the "false alarm" or random noise rejection capability of the system. In this manner, the detector surface configuration of this invention enables a seeker system to have the ability to discriminate against overly large sources such as cloud edges since these will tend to cross several detector elements simultaneously. It should be clear that a logic processor which has the information as to when the target crossed each of the detector elements in the array can discriminate against false targets more effectively than a single detector system. The very compact array makes it possible to improve signal processing since the target image will normally pass over several detector elements within a period not exceeding about seven times the time required to pass over one detector element in the array. If the array diameter is about three times the diameter of a single element, the target image will pass over several detector elements within a time period of about three times that necessary to pass over one detector element.

From the disclosed structure it can be appreciated that a detector array fabricated in accordance with this invention has several major performance advantages over the single detector system, among them being a substantial increase in data rate since there are more detector elements to provide target-indicating signals, having the same effect as would an additional number of sweeps of the scanner. Other advantages as previously mentioned are improved sensitivity and background discrimination. As compared with the small discrete detector elements of the present invention, a larger single detector element cannot as readily reject different targets depending on the frequency of the background in the field of view of the seeker.

Advantages of this invention which are not immediately apparent are that this improved detector arrangement of multiple small discrete detector elements in a close packed cluster does not significantly raise the cost of the single detector element rosette seeker of the prior art, while at the same time substantially improving the performance, all with no significant change in size and weight for the seeker system. Additionally, the detector array configuration of this invention can be produced to be compatible with existing small seeker, single element systems, even for small shoulder launched missiles. This close packed, or clustered, array has the significant advantage that all of the information which is obtained by any particular crossing of the detector array will be obtained during the short time (typically a few hundred microseconds) which is required for the rapidly scanning image to scan a distance equal to the outside diameter of the clustered array. Therefore, signal processing for noise rejection or other target enhancement purposes can be accomplished based on a single crossing of the detector array. Some of the more expensive known seeker systems, such as focal plane array seekers, are not readily adaptable to rolling airframes for various gyrodynamic reasons, but the present invention is equally functional in rolling airframe missiles as with other types of missiles.

Returning now to FIGS. 4–6, it should be understood that the target image paths shown are typical examples of the random paths generated by the seeker scanning process. Note particularly in FIG. 6 that the target might not have been detected by the single central detector 35 shown in FIG. 3, whereas with the added ring of elements 44 the target is easily detected. Additionally, since the target image rate is known within reasonable limits, the time between detections in a single target sweep by the various detectors is fairly well known.

The detector array configuration of the present invention also leads to the possibility of time based filtering techniques being used to enhance the signal-to-noise ratio thereby further improving this system's sensitivity. As a general rule, odd numbers of peripheral or ring detector elements are preferred over arrays of even numbers of ring elements since it is more difficult for the target image path to pass between elements without detection in the odd numbered ring than in the ring with an even number of detector elements.

Figure 7:
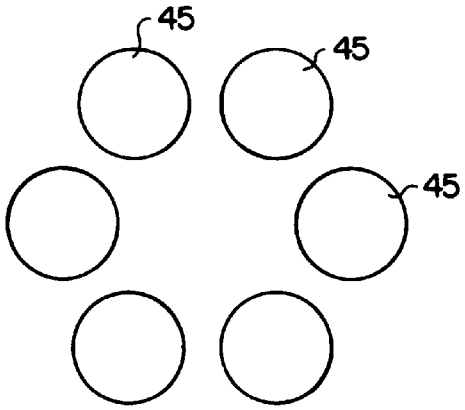
FIG. 7 is another alternative of a circular detector array without a central element.

The central detector element could be eliminated, as shown in FIG. 7, if the outer ring of elements 45 is sufficiently densely packed. Although closing the tracking loop with this configuration may be somewhat more difficult than with arrays having a central detector element, all of the information is available to allow excellent tracking performance provided target paths can only rarely pass between adjacent elements without being detected. The fact that the tracking loop is closed with somewhat more difficulty stems from the fact that slight pointing errors could more readily occur because all of the detector elements are off center.

Figure 8:
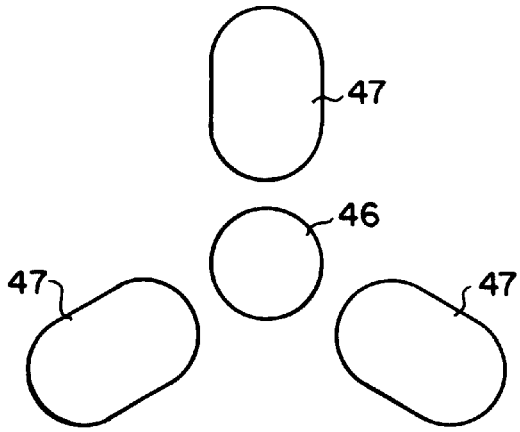
FIGS. 8–10 disclose alternative detector array configurations employing elongated detector elements.
Figure 9:
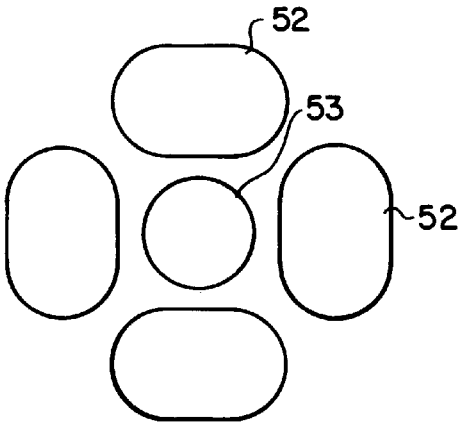
Figure 10:
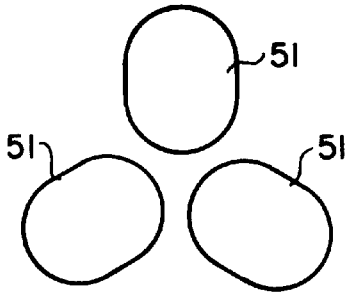

Generally speaking, in order for a scanning detector seeker system to obtain optimum sensitivity as required for passive target detection, each detector element should be round and have a diameter approximately the same as the image of a point source target as it falls on the planar surface of the detector array. Even so, individual detector elements of an array need not all be of the same size and shape. Elongated or oval elements are employed in the arrays shown in FIGS. 8–10. The array of FIG. 8 comprises a central circular spot detector element 46 with three radially arranged oval elements 47. FIG. 10 is a modified version of FIG. 8 where oval detector elements 51 are similarly arranged about the central point but closer together and without any centrally located element. The detector array of FIG. 9 employs four oval elements 52 arranged circumferentially around central circular spot detector element 53. Potential problems may arise in use of these detector arrays resulting from the different times required for the image to cross the non-circular detector elements. Depending on the direction of travel and the fact that the image itself is more or less round and therefore more closely matched to the circular element shape, the result may be somewhat lower sensitivity for the non-circular configuration. However, the lower sensitivity may be balanced by other performance gains such as higher data rates off axis.

The various detector array configurations are shown as examples only. Many other structures are possible but it is important that the detector elements be located close enough together to allow the defocus effect at required seeker look angles to be tolerated without resorting to gimbaling the detector array assembly or connecting it to a gimbaled aperture array by means of fiber optics or other similar structures.

What is claimed is:

1. A detector array for a rosette scan seeker for use in an airframe, the seeker optical elements producing an information spot scanning image of the distant field of view focused on an image plane, said detector array being fixed with respect to said airframe and comprising:

a detector surface positioned at the image plane; and a plurality of discrete detector elements responsive to radiant energy, said elements being symmetrically arranged in an array about a central point on said detector surface, each of said detector elements being adapted to provide a separate signal each time the seeker scan sweeps across one of said elements;

the maximum size of said detector array on said detector surface on which said elements are arranged is such that, in relation to the seeker scan, the seeker scan converging information spot remains substantially focused on any of said detector elements located on said detector surface.

2. The detector array recited in claim 1 wherein the distance between adjacent detector elements is no greater than the diameter of any individual element in said array.

3. The detector array recited in claim 1 wherein the diameter of said detector surface is no more than about seven times the diameter of any single detector element on said surface.

4. The detector array recited in claim 1 wherein the diameter of said detector surface is no less than about three times the diameter of any single detector element on said surface.

5. The detector array recited in claim 1 wherein the diameter of said detector surface is in the range of about three to seven times the diameter of any single detector element on said surface.

6. The detector array recited in claim 1 wherein said detector array comprises a ring of closely spaced elements equidistant from said central point.

7. The detector array recited in claim 6 wherein said detector array further comprises a detector element centered on said central point and surrounded by said ring of detector elements.

8. The detector array recited in claim 1 wherein each of said detector elements is circular.

9. The detector array recited in claim 1 wherein at least some of said detector elements are oval.

10. The detector array recited in claim 1 wherein each said detector element has a diameter approximately equal to the diameter of the image of a point source target focused on said detector surface.

11. The detector array recited in claim 1 wherein said detector elements are so arranged on said detector surface that in a single sweep of a point source target image across detector elements and said detector surface are substantially coplanar.

12. The detector array recited in claim 1, wherein each said detector element is spaced from every other detector element.

13. The detector array recited in claim 1, wherein said detector elements are substantially equidistant about said central point.

14. The detector array recited in claim 1, wherein said detector elements and said detector surface are substantially coplanar.

15. The detector array recited in claim 1, wherein the minimum size of said detector surface is no less than about three times the smallest dimension of any single detector element on said detector surface.

16. A detector array for a rosette scan seeker for use in an airframe, the seeker optical elements producing an information spot scanning image of the distant field of view focused on an image plane, said detector array being fixed with respect to said airframe and comprising:

a detector surface positioned at the image plane; and a plurality of discrete detector elements responsive to radiant energy, said elements being symmetrically arranged in an array about a central point on said detector surface, each of said detector elements being adapted to provide a separate signal each time the seeker scan sweeps across one of said elements;

said detector elements being closely clustered in an array on said detector surface such that the seeker scan converging information spot remains substantially focused as it sweeps across any of said detector elements.

17. The detector array recited in claim 16 wherein the distance between adjacent detector elements is no greater than the diameter of any individual element in said array.

18. The detector array recited in claim 16 wherein the diameter of said detector surface is no more than about seven times the diameter of any single detector element on said surface.

19. The detector array recited in claim 16 wherein the diameter of said detector surface is no less than about three times the diameter of any single detector element on said surface.

20. The detector array recited in claim 16 wherein the diameter of said detector surface is in the range of about three to seven times the diameter of any single detector element on said surface.

21. The detector array recited in claim 16 wherein said detector array comprises a ring of closely spaced detector elements equidistant from said central point.

22. The detector array recited in claim 21 wherein said detector array further comprises a detector element centered on said central point and surrounded by said ring of detector elements.

23. The detector array recited in claim 16 wherein each of said detector elements is circular.

24. The detector array recited in claim 16 wherein at least some of said detector elements are oval.

25. The detector array recited in claim 16 wherein each said detector element has a diameter approximately equal to the diameter of the image of a point source target focused on said detector surface.

26. The detector array recited in claim 16 wherein said detector elements are so arranged on said detector surface that in a single sweep of a point source target image across said detector surface at least two said detector elements are illuminated.

27. The detector array recited in claim 16, wherein each said detector element is spaced from every other detector element.

28. The detector array recited in claim 16 wherein said detector elements are substantially equidistant about said central point.

29. The detector array recited in claim 16, wherein said detector elements and said detector surface are substantially coplanar.

30. The detector array recited in claim 16, wherein the minimum size of said detector surface is no less than about three times the smallest dimension of any single detector element on said detector surface.

31. A detector array for a rosette scan seeker for use in an airframe, the seeker optical elements producing an information spot scanning image of the distant field of view focused on an image plane, said detector array being fixed with respect to said airframe and comprising:

a detector surface positioned at the image plane; and a plurality of discrete detector elements responsive to radiant energy, said elements being arranged in an array on said detector surface, each of said detector elements being adapted to independently provide a signal each time the seeker scan sweeps across one of said elements;

the maximum distance from the center to the most distant said detector element of said detector array on said detector surface on which said elements are arranged is such that the seeker scan converging information spot remains substantially focused on any of said detector elements located on said detector surface.

32. The detector array recited in claim 31, wherein each said detector element is spaced from every other detector element.

33. The detector array recited in claim 31, wherein said detector elements and said detector surface are substantially coplanar.

34. The detector array recited in claim 31, wherein each said detector element has a diameter approximately equal to the diameter of the image of a point source target focused on said detector surface.

35. The detector array recited in claim 31, wherein said detector elements are so arranged on said detector surface that in a single sweep of a point source target image across said detector surface at least two said detector elements are illuminated.

36. The detector array recited in claim 31, wherein at least some of said detector elements are oval.

37. A detector array for a rosette scan seeker for use in an airframe, the seeker optical elements producing an information spot scanning image of the distant field of view focused on an image plane, said detector array being fixed with respect to said airframe and comprising:

a detector surface positioned at the image plane; and a plurality of discrete detector elements responsive to radiant energy, said elements being arranged in an array on said detector surface, each of said detector elements being adapted to independently provide a signal each time the seeker scan information spot sweeps across one of said elements;

said detector elements being closely clustered in an array on said detector surface such that the seeker scan converging information spot remains substantially focused as it sweeps across any of said detector elements.

38. The detector array recited in claim 37, wherein the distance from the center of said detector array to the outermost said detector element is such as to maintain focus of the information spot.

39. The detector array recited in clam 37, wherein each said detector element is spaced from every other detector element.

40. The detector array recited in claim 37, wherein said detector elements and said detector surface are substantially coplanar.

41. The detector array recited in claim 37, wherein each said detector element has a diameter approximately equal to the diameter of the image of a point source target focused on said detector surface.

42. The detector array recited in claim 37, wherein said detector elements are so arranged on said detector surface that in a single sweep of a point source target image across said detector surface at least two said detector elements are illuminated.

43. The detector array recited in claim 37, wherein at least some of said detector elements are oval.

* * * * *